US010733861B2

(12) United States Patent
Russo

(10) Patent No.: US 10,733,861 B2
(45) Date of Patent: Aug. 4, 2020

(54) LOCATION CONTROL SYSTEM AND METHOD

(71) Applicant: Avigilon Corporation, Vancouver (CA)

(72) Inventor: Pietro Russo, Melrose, MA (US)

(73) Assignee: Avigilon Corporation, Vancouver (CA)

( * ) Notice: Subject to any disclaimer, the term of this patent is extended or adjusted under 35 U.S.C. 154(b) by 0 days.

(21) Appl. No.: 15/820,118

(22) Filed: Nov. 21, 2017

(65) Prior Publication Data

US 2018/0144594 A1 May 24, 2018

Related U.S. Application Data

(60) Provisional application No. 62/425,460, filed on Nov. 22, 2016.

(51) Int. Cl.

| | |
|---|---|
| ***G08B 13/00*** | (2006.01) |
| ***G08B 13/24*** | (2006.01) |
| ***G07C 9/00*** | (2020.01) |
| ***G08B 13/196*** | (2006.01) |

(52) U.S. Cl.

CPC ..... *G08B 13/24* (2013.01); *G07C 9/00174* (2013.01); *G07C 9/00571* (2013.01); *G08B 13/19613* (2013.01); *G07C 2009/00769* (2013.01); *G07C 2209/64* (2013.01)

(58) Field of Classification Search

CPC ..... G07C 9/00174; G07C 9/00126; G07C 9/00158; G07C 9/00571; G07C 2009/00769; G07C 2209/64; G08B 13/24; G08B 13/19613

See application file for complete search history.

(56) References Cited

U.S. PATENT DOCUMENTS 5,345,240 A * 9/1994 Frazier ..... G01S 7/003 342/22
5,845,692 A * 12/1998 Kellem ..... E05G 5/003 160/118
6,466,155 B2 * 10/2002 Taylor ..... G01S 7/14 342/159
6,720,874 B2 * 4/2004 Fufido ..... G07C 9/00031 340/5.2
6,856,272 B2 * 2/2005 Levitan ..... F41H 13/00 342/22

(Continued)

OTHER PUBLICATIONS

International Search Report and Written Opinion dated Jan. 24, 2018, issued by the Canadian Intellectual Property Office in PCT Application No. PCT/CA2017/051386, filed Nov. 21, 2017.

*Primary Examiner* — Hai Phan
*Assistant Examiner* — Son M Tang
(74) *Attorney, Agent, or Firm* — Daniel Hammond

(57) ABSTRACT

A method and system for controlling a passage from a secured location to an unsecured location based on presence detection of the unsecured location, including: a radar system in the secure location configured to transmit radar signals to and receive radar signals from the unsecured location; on determination of the presence, by the radar system, of a first person in the unsecured location proximate to the passage, providing an alert. The determination of the presence of the first person in the unsecured location may be triggered by a second person in the secured location moving proximate to the exit or by the second person in the secured location requesting to exit through the passage.

13 Claims, 14 Drawing Sheets

(56) References Cited

U.S. PATENT DOCUMENTS 7,148,836 B2 * 12/2006 Romero ..... A61B 5/0507 342/22
7,382,895 B2 * 6/2008 Bramblet ..... G07C 9/00 382/103
7,466,224 B2 * 12/2008 Ward ..... G07C 9/00111 340/5.2
7,920,718 B2 * 4/2011 Marrion ..... G06K 9/00771 340/540
8,102,238 B2 * 1/2012 Golander ..... G07C 9/00111 235/375
8,169,317 B2 * 5/2012 Lemerand ..... E05F 15/70 340/521
8,749,344 B2 * 6/2014 Brunetti ..... G07C 9/15 340/5.7
8,907,792 B2 * 12/2014 Mezger ..... G08B 13/183 340/5.6
8,970,369 B2 * 3/2015 Bird ..... G08B 13/184 340/5.61
9,613,524 B1 * 4/2017 Lamb ..... G08B 29/185
9,905,101 B1 * 2/2018 Billau ..... G07C 9/00007
2004/0212493 A1 * 10/2004 Stilp ..... G06K 7/0008 340/531
2006/0170584 A1 8/2006 Romero et al.
2006/0279294 A1 * 12/2006 Cehelnik ..... G08B 13/26 324/662
2007/0024487 A1 * 2/2007 Zemany ..... G01S 13/38 342/22
2007/0024488 A1 * 2/2007 Zemany ..... G01S 13/36 342/22
2007/0268145 A1 * 11/2007 Bazakos ..... G07C 9/28 340/573.1
2008/0028682 A1 * 2/2008 Casella ..... E05G 5/003 49/25
2008/0111729 A1 * 5/2008 Zemany ..... G01S 13/32 342/22
2009/0033539 A1 * 2/2009 Zemany ..... G01S 13/56 342/22
2009/0135045 A1 * 5/2009 Beeri ..... G01S 7/415 342/22
2011/0025546 A1 * 2/2011 Cook ..... G01S 7/2923 342/22
2012/0127304 A1 * 5/2012 Tsuji ..... G08B 13/19613 348/135
2013/0300573 A1 * 11/2013 Brown ..... A61B 5/1113 340/870.01
2015/0301167 A1 10/2015 Sentelle et al.
2017/0220872 A1 * 8/2017 Child ..... G06K 9/00771
2017/0243458 A1 * 8/2017 Langford ..... G08B 5/36

* cited by examiner

LOCATION CONTROL SYSTEM AND METHOD

RELATED APPLICATION

This application claims the benefit of U.S. Provisional Patent Application No. 62/425,460 filed on Nov. 22, 2016, which is hereby incorporated by reference in its entirety.

TECHNICAL FIELD

The present disclosure is directed at a physical security system that is used to control an exit from a location.

BACKGROUND

A physical security system is a system that implements measures, such as a barrier, to prevent unauthorized persons from gaining physical access to an asset, such as a building, a facility, or confidential information. Other examples of physical security systems include surveillance systems, such as a system in which cameras are used to monitor the asset and those in proximity to it; access control systems, such as a system that uses RFID cards to control access to a building; intrusion detection systems, such as a home burglary alarm system; Request-to-Exit (REX) systems, such as a system that controls a person's ability to exit a location; and combinations of the foregoing systems.

REX systems typically include one or more of a push-button, a card reader, or a motion detector. For example, when the button is pushed, the motion detector detects motion at the door, or the card reader reads an access card with appropriate credentials, a door alarm is temporarily ignored while the door is opened. In cases in which a lock must be electrically unlocked for exit, the REX system also unlocks the door to allow passage through the exit. Exiting a door without having to electrically unlock the door is called mechanical free passage, which is also a safety feature.

Physical security systems, such as barriers, separate the protected asset, such as a room or building, from other locations, referred to herein as "unsecured". Unsecured locations may include publicly accessible areas, or areas which are less secure than the "secured location", which may occur, for example, in the case of a building with multiple levels of security.

A challenge with controlling movement through a passage in a barrier, for example allowing persons to exit through a door from a secured location to an unsecured location, is that persons positioned near the passage may be able to take advantage of the passage opening to enter the secured location without credentials. For example, a person waiting outside a door may slip in through the door as a credentialed person exits. Thus when a person leaves a secured location to enter an unsecured location, the open passage between the two locations creates a security risk since an unauthorized person might be in the unsecured location waiting, for example, for a door to become unlocked and/or opened, and then the unauthorized person may enter the secured location.

SUMMARY

According to a first aspect, there is provided a means to prevent an unauthorized person from sneaking into a secured location, or to provide an alarm so that the unauthorized person can be quickly located and removed from the secured location.

According to another aspect, there is provided a method for controlling a passage from a secured location to an unsecured location, including: providing a radar system in the secured location, the radar system configured to transmit radar signals to and receive radar signals from the unsecured location proximate to the passage; and on determination of the presence, by the radar system, of a first person in the unsecured location proximate to the passage, providing an alert. The passage may be an exit, and the determination of the presence of the first person in the unsecured location may be triggered by a second person in the secured location moving proximate to the exit. The passage may be an entrance, and the determination of the presence of the first person in the secured location is triggered by a second person in the unsecured location moving proximate to the entrance.

According to another aspect the determination of the presence of the first person in the secured location is triggered by a second person in the unsecured location requesting to enter through the passage or the determination of the presence of the first person in the unsecured location is triggered by a second person in the secured location requesting to exit through the passage.

According to another aspect the passage is secured. The passage may be opened when the radar system does not determine the presence of the first person or if the person presents credentials.

According to another aspect, an alert is provided to the second person. According to another aspect, the passage allows movement through a barrier. The passage may be a door or a gate. The barrier may be a wall, a hedge or a gate.

According to another aspect, a physical security system is provided, including: a radar system located in a secured location, the radar system configured to receive radar signals from an unsecured location outside a passage from the secured location to an unsecured location; a processor in communication with the radar system and configured to: determine, using the radar signals, if the radar signals indicate a presence of a first person in the unsecured location; and on determination of the presence of the first person, providing instructions to cause an alert or prevent use of the passage.

According to another aspect, a physical security system is provided, including: a radar system located in an unsecured location, the radar system configured to receive radar signals from a secured location outside a passage from the unsecured location to the secured location; a processor in communication with the radar system and configured to: determine, using the radar signals, if the radar signals indicate a presence of a first person in the unsecured location; and on determination of the presence of the first person, providing instructions to cause an alert or prevent use of the passage.

According to another aspect, there is provided a non-transitory computer readable medium having encoded thereon computer program code that, when executed, causes a processor to perform any of the foregoing aspects of the method and suitable combinations thereof.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

In the accompanying drawings, which illustrate one or more example embodiments.

Figure 1A:
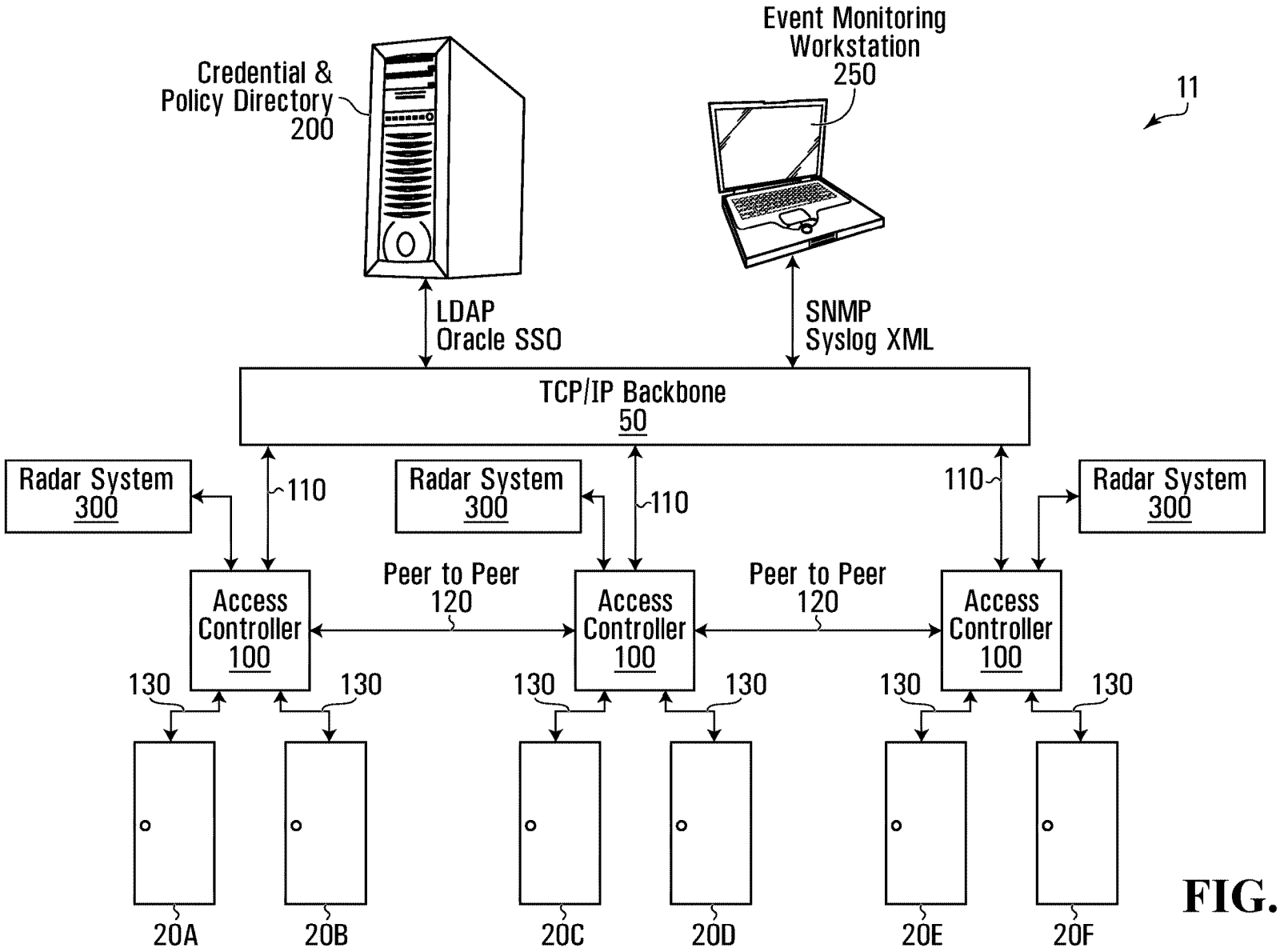
FIGS. 1A-IC illustrate an example access control system and select components thereof, according to an embodiment.

It will be appreciated that for simplicity and clarity of illustration, elements shown in the figures have not necessarily been drawn to scale. For example, the dimensions of some of the elements may be exaggerated relative to other elements for clarity. Furthermore, where considered appropriate, reference numerals may be repeated among the figures to indicate corresponding or analogous elements.

DETAILED DESCRIPTION

A detailed description of one or more embodiments is provided below along with accompanying figures that illustrate the principles thereof. The scope is limited only by the claims and encompass numerous alternatives, modifications and equivalents. Numerous specific details are set forth in the following description in order to provide a thorough understanding. These details are provided for the purpose of example and the systems and methods described herein may be practiced according to the claims without some or all of these specific details. For the purpose of clarity, technical material that is known in the technical fields related to the invention has not been described in detail so that the invention is not unnecessarily obscured.

Directional terms such as "top", "bottom", "upwards", "downwards", "vertically", and "laterally" are used in the following description for the purpose of providing relative reference only, and are not intended to suggest any limitations on how any article is to be positioned during use, or to be mounted in an assembly or relative to an environment. Additionally, the term "couple" and variants of it such as "coupled", "couples", and "coupling" as used in this description is intended to include indirect and direct connections unless otherwise indicated. For example, if a first device is coupled to a second device, that coupling may be through a direct connection or through an indirect connection via other devices and connections. Similarly, if the first device is communicatively coupled to the second device, communication may be through a direct connection or through an indirect connection via other devices and connections.

The term "passage" means a position in a barrier through which persons or animals can move from a secured location to an unsecured location or an unsecured location to a secured location. An example of passage includes a door or gate.

The term "barrier" means a physical or electronic barrier between the secured location and the unsecured location that serves as access control and prevents movement from the unsecured location to the secured location or from the secured position to the unsecured position. The barrier is typically solid, like a wall or hedge, but may be a geofence using a GPS tracking device or the like.

The term "secured location" means a location protected by access control and a barrier, i.e. a location to which access is permitted only with the appropriate credentials.

The term "unsecured location" is defined relative to a secured location, i.e. an unsecured location is a location with a lower level of security than a secured location, and only those with proper credentials may enter the secured location. An unsecured location may be a publicly accessible area. A barrier separates the unsecured location and the secured location and access control prevents movement from the unsecured location to the secured location unless proper credentials are available.

The term "open" is used to mean a state of a passage or barrier such that movement is permitted through the barrier, for example through the passage, or through a portion of a barrier, and may include physically opening a door, unlocking a door, and/or disabling an alarm.

The term "access controller" means a device programmed (or the program itself), to make access decisions based on a cached database supplied by an identity store. Access requests are made via a sensing device (card reader, push button, etc.); authorization is checked either locally or by referring to a remote identity store for processing. If an access request is approved, output and input devices/systems (e.g., entry doors) are manipulated to allow access.

The term "door controller" means a device in communication with the access controller and physically (e.g., wired or wireless) attached to a credential reader and associated input and output hardware. The door controller sends changes of state and credential reads to the access controller, waits for an authorization response from the access controller, and commands attached input, output and credential readers according to the authorization response.

The term "identity store" (or "directory") means a database including relational, hierarchical, networked or other architectures that includes authorization and authentication data for individuals, credentials, resources, and group memberships. The identity store may reside at a facility owned and operated by an entity different from the entity owning and/or operating the protected area.

The terms "an aspect", "an embodiment", "embodiment", "embodiments", "the embodiment", "the embodiments", "one or more embodiments", "some embodiments", "certain embodiments", "one embodiment", "another embodiment" and the like mean "one or more (but not all) embodiments", unless expressly specified otherwise. A reference to "another embodiment" or "another aspect" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise. The term "herein" means "in the present application, including anything which may be incorporated by reference", unless expressly specified otherwise.

The term "e.g." and like terms mean "for example", and thus does not limit the term or phrase it explains.

The term "respective" and like terms mean "taken individually". Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

Where two or more terms or phrases are synonymous (e.g., because of an explicit statement that the terms or phrases are synonymous), instances of one such term/phrase does not mean instances of another such term/phrase must have a different meaning. For example, where a statement renders the meaning of "including" to be synonymous with "including but not limited to", the mere usage of the phrase "including but not limited to" does not mean that the term "including" means something other than "including but not limited to".

Neither the Title (set forth at the beginning of the first page of the present application) nor the Abstract (set forth at the end of the present application) is to be taken as limiting in any way as the scope of the disclosed invention(s). An Abstract has been included in this application merely because an Abstract of not more than 150 words is required under 37 C.F.R. Section 1.72(b) or similar law in other jurisdictions. The title of the present application and headings of sections provided in the present application are for convenience only, and are not to be taken as limiting the disclosure in any way.

Numerous embodiments are described in the present application, and are presented for illustrative purposes only. The described embodiments are not, and are not intended to be, limiting in any sense. The presently disclosed aspect(s) are widely applicable to numerous embodiments, as is readily apparent from the disclosure. One of ordinary skill in the art will recognize that the disclosed aspect(s) may be practiced with various modifications and alterations, such as structural and logical modifications. Although particular features of the disclosed aspect(s) may be described with reference to one or more particular embodiments and/or drawings, it should be understood that such features are not limited to usage in the one or more particular embodiments or drawings with reference to which they are described, unless expressly specified otherwise.

No embodiment of method steps or system elements described in the present application is essential or is coextensive, except where it is either expressly stated to be so in this specification or expressly recited in a claim.

Access Control Systems

Ensuring that only authorized individuals access secured locations may be crucially important (e.g., at an airport, a military installation, office building etc.). Secured locations may be defined by passages, such as physical doors (for example, doors through which a human may enter) and barriers such as walls, or may be virtually defined in other ways. For instance, a secured location may be one in which unauthorized entry causes a detector to signal intrusion and possibly send a signal or sound an alarm if authorization is not provided.

Access control systems may limit entry into secured locations of buildings, rooms within buildings, or fenced-in regions, and assets and resources therein, to only those individuals who have permission to enter.

Thus, an access control system, fundamentally, should identify the individual attempting to enter the secured location and verify the individual is currently authorized entry or access. Access control systems, devices, and methods may encompass any access technology, including:

(1) using PINs and passwords that can be entered at a key pad associated with the access point (e.g., a door);

(2) using biometrics that can be entered by individuals via special readers associated with the door;

(3) using traditional signatures, provided by the individuals via a special pad associated with the door;

(4) using smart cards or contactless cards (e.g., sending a PIN to the door via a special reader/receiver);

(5) using a digital certificate; e.g., one stored in a smart card, contactless card, or a wireless device, that can "communicate to the door" via a card reader or other receiver; and (6) using a physical key inserted into a door lock; such a key/lock mechanism may include a special encoding on the key that is read in the lock.

The above list of access technologies is not meant to be exhaustive. Furthermore, some facilities may use combinations of these technologies. The technologies may be used in any environment, including in government facilities, private businesses, public facilities, and in an individual's home.

As a further explanation of some of the above access technologies, some current access control systems use doors equipped with an entry device such as a key pad, through which an individual enters a PIN or password. The key pad has an attached memory or elementary processor in which a list of valid PINs/passwords is stored, so that the PIN/password may be checked to determine whether it still is valid. If the PIN/password is valid, the door opens; otherwise the door remains locked.

Some current card-based access control systems use radio frequency identification (RFID) technology. The access card reader includes an RFID transceiver, and the access card includes an RFID tag or transponder. The RFID transceiver transmits a radio frequency (RF) query to the card as the card passes over RFID transceiver. The RF transponder includes a silicon chip and an antenna that enables the card to receive and respond to the RF query. The response is typically an RF signal that includes a pre-programmed identification (ID) number. The card reader receives the signal and transmits the ID number to a control panel using a wired or wireless connection. Card readers may perform some basic formatting of the identification data prior to sending the data to the control panel, but generally do not perform higher level functions.

Some access controllers may rely on proprietary protocols and software to provision/de-provision credentials, provide configuration information, and report transactions. The proprietary nature of these access controllers limits a customer's options with respect to implementing changes, adding new features, and generally moving to other technology solutions once a specific manufacturer's products have been selected and installed. As access controllers move away from RS232/485 communications and onto a TCP/IP network communication medium, proprietary protocols are less acceptable to customers.

Furthermore, as physical security systems increase their reliance of an organization's information technology (IT) infrastructure, IT departments may look for options for reducing costs and time to deploy. This requires systems to follow standards both in installation and communications. The additional benefit provides interoperability between logical and physical security systems using standards and commercial off the shelf products.

There are also self-provisioning access controllers and related access control systems, which may be used for controlling physical access to buildings, structures, and locations.

The access controller is a software application capable of executing on a commercial off the shelf computer running, for example, the Linux operating system. The computer may be designed for desktop, rack mountable, cloud based or an embedded platform such as an access controller. The computer provides the necessary processor, storage and connectivity for the software application. All required software is loaded onto the computer without requiring any installation of software onto any other computer system.

The access controller maintains credentials and associated access privileges and transmits in real time events using an existing information technology (IT) infrastructure and databases without the need to access or otherwise use proprietary communication protocols.

The access controller, as a self-provisioning access device, may obtain and maintain a cached list of credentials and associated access privileges; this data allows the access controller to make on-the-spot, real-time access decisions without communication to any other access control system(s). The cache of credentials and associated access privileges may be acquired from one or more host systems periodically, including on a schedule, in real time, or as a complete snapshot. For example, the access controller may, in effect, continuously access a host system directory of access credentials and associated access privileges, and download some of all of the credentials and privileges. In an aspect, the access controller downloads this data for a select number of individuals. An individual for whom the data is downloaded may be uniquely identified, identified by group association, or identified by assigned roles(s).

The access controller may be used in either real-time, on demand, or on a schedule, to send real time events to a logging and monitoring device or system. In an aspect, an event may be an access door unlocking or locking, an access door open or closed signal (e.g., from a limit switch or position sensor, or based on a logic routine), an access door fault or unusual operation (open for a time exceeding a variable threshold), etc. The events may be sent in any number of formats, including XML, directly into a relational database or system logging facility of any number of remote devices or systems. If connectivity is lost, the access controller may buffer the events and may continue event transmission when connectivity is re-established.

The access controller may contain or provide a browser-accessible user interface. The interface provides an access control system operator the ability to configure any number of access points (e.g., doors) and their operation, and associated mapping to individuals and/or groups (on an individual basis, group basis, and/or defined role basis) to convey access privileges. With the same interface, the operator may configure the access controller to communicate with credential sources, including credential sources implemented in or using a relational database, a directory or hierarchical data store, or flat files such as comma-separated value (CSV) file, or any common ASCII file.

With the interface, the operator selects and configures a type of data synchronization including timed intervals, scheduled, on-demand, and real-time. The synchronization methods may include subscription, in which a host access credentials and policy system "pushes" information changes to the access controller; audit trail, in which the access controller requests information updates; or data modification triggers, in which code written into the host system detects information changes and sends the changed information to the access controller. The subscription method may require a persistent, always-on connection between the host system and the access controller while the other example two methods may use a transient connection.

The access controller initiates connection(s) to the sources and retrieves the credential and policy information to build the controller's local cache. Each individual may have a unique identifier to collate the individual's information from multiple sources into a single record. Once transferred to the local cache, the information may be used in access decisions as credentials are presented at access control points.

Figure 1B:
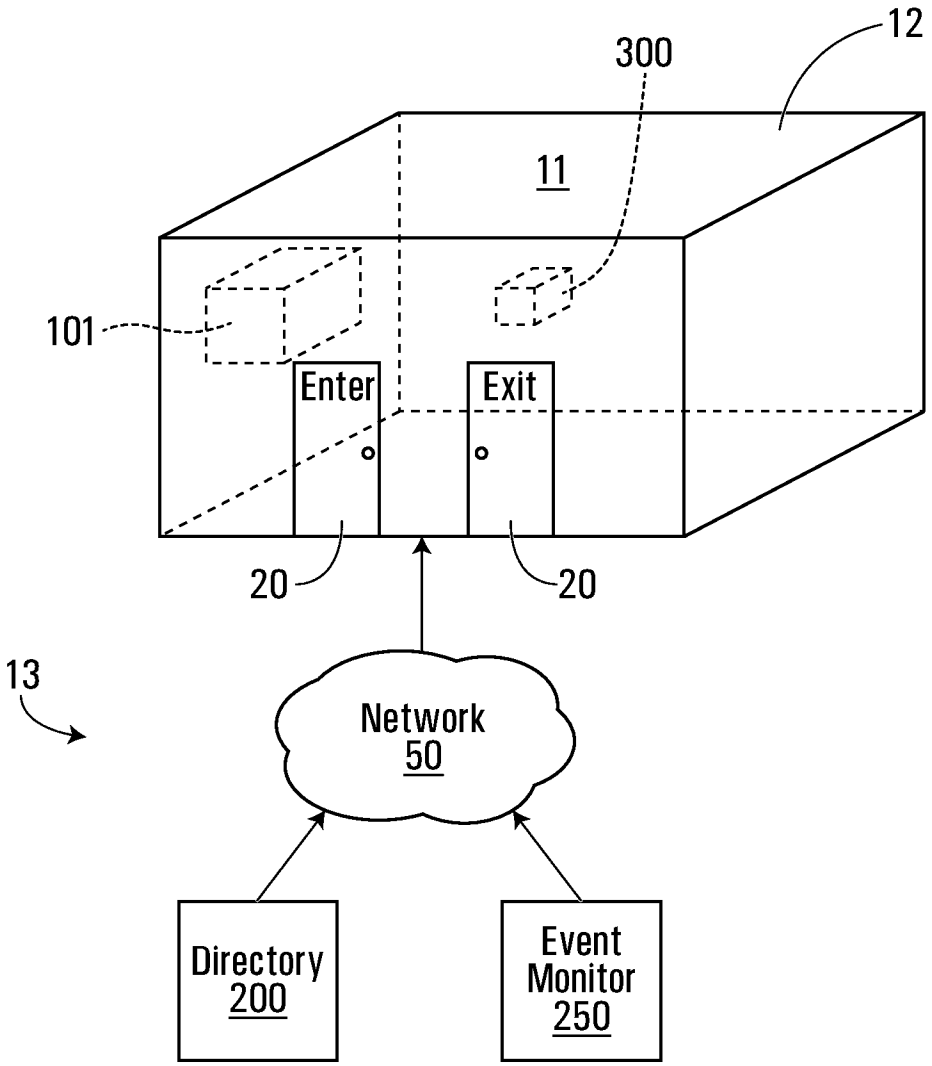
Figure 1C:
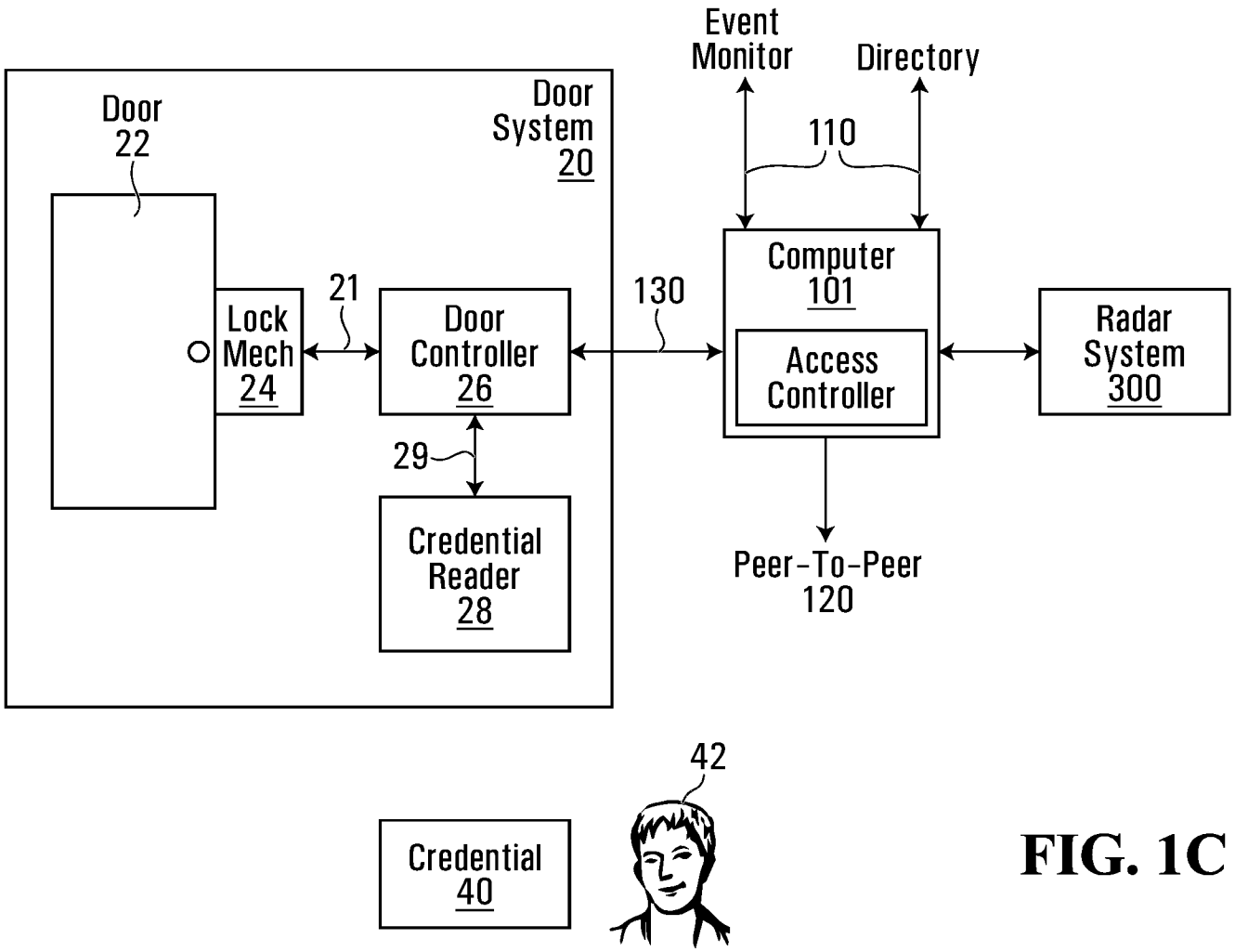

FIGS. 1A-C illustrate an example access control system and select components thereof. In FIG. 1A, access control system 11 includes door systems 20 (illustrated as 20A to 20F), access controllers 100, credential and policy directory 200, event monitoring workstation 250, and radar systems 300, all of which are intended to limit or control access to a secured location. The controllers 100 communicate 110 with the directory 200 and workstation 250 using, for example, a network 50, such as a TCP/IP backbone. Network 50 may be wired or wireless, or a combination of wired and wireless. Network 50 may include elements of a local area network (LAN) and a wide area network (WAN), including the Internet. Communications 110 between an access controller 100 and the directory 200, and between the controller 100, radar systems 300, and the workstation 250 may be secure communications (e.g., HTTPS communications).

Radar system 300 is a particular embodiment of a radio wave system that can be implemented to detect the presence of a person as described below. Other forms of radio waves that can permeate through walls and other barriers, for example a Wi-Fi system, may be used instead of, or in conjunction with, radar system 300.

FIG. 1B illustrates selected components of the access system 11 to limit or control access by individuals to secured location 12. As shown, the secured location 12 is a six-sided structure with an entry door system 20 and an exit door system 20. The door systems 20 are described with reference to FIGS. 1A and 1C. The door systems 20 are intended for normal human access. Other access points (e.g., windows) may exist, and their operation may be monitored, alarmed, and controlled, but such access points are not described further herein. Radar system 300 is positioned within secured location 12 such that radar system 300 can monitor the area outside of exit door system 20 in the unsecured location 13.

The secured location 12 may include a computing platform 101 on which are implemented access control features that control, monitor, and report on operation of the door systems 20. The computing platform 101 may be fixed or mobile. The computing platform 101 is shown inside the secured location 12 but need not be. In executing its control, monitoring, and reporting functions, the computing platform 101 with its access control features may communicate external to the secured location 12 by way of network 50 with the (remote) directory 200 and with (remote) event monitoring workstation 250. The network 50 may be wired or wireless, and may provide for secure communications and signaling in addition to non-secure communications and signaling.

The secured location 12 may be a room in a building, the building itself, or any other structure. The secured location 12 is not limited to a six-sided configuration. The secured location 12 could be an open structure (e.g., a sports stadium), a fenced-in area (e.g., an area surrounding a runway), or an area having an "invisible" fence or "virtual walls." The secured location 12 may be geographically fixed (e.g., a building, a room in a building) or mobile (e.g., a trailer, airplane, ship, or container).

The secured location 12 may be used to control access to government or business-classified documents or devices contained therein, access to computer systems contained therein, access to individuals, access to valuable items such as rare paintings, jewelry, etc., and access to dangerous materials or systems. The secured location 12 may be a safe or vault at a bank, a control room for a nuclear reactor, a hangar for a classified, new-technology airplane, a behavior health ward or other medical facility, or a passenger gate at an airport.

In a mobile configuration, the secured location 12 may be used, for example, in field operations to quickly establish a secure facility anywhere in the world. Moreover, the mobile secured location may be used for very different operations, with different individuals able to access the mobile secured location 12, depending on its intended use, by simple configuration changes implemented through a user interface. Thus, the system 11 provides not only high levels of security, access control, event monitoring and reporting, but also the flexibility to quickly adapt the mobile secured location 12 to any operation or mission, anywhere in the world, for which access control is desired.

Returning to FIG. 1A, the access controllers 100 also may communicate between and among themselves using peer-to-peer communications 120. Such peer-to-peer communications 120 may be enabled by use of a secure LAN, for example. Alternately, the peer-to-peer communications 120 may be wireless secure communications. The peer-to-peer communications 120 also may follow the TCP/IP protocol.

The peer-to-peer communications 120 allow an access controller 100 to send and receive access status information and events to and from the other access controllers used in the secured location 12. Thus, if a door system 20 is inoperative, its associated access controller 100 may provide this information to the other access controllers 100. The peer-to-peer communications 120 allow one access controller 100 to act as a parent (master) access controller and the remaining access controllers 100 to act as child (subservient) access controllers. In this aspect, information and configurations may be stored or implemented on the parent access controller and then may be replicated on the child access controllers.

Finally, the access controller 100 may communicate with the door systems 20 using wired or wireless secure communications 130.

The door systems 20, which are described in more detail with reference to FIG. 1B, control normal human access to a secured location 12. In the example of FIG. 1A, six door systems 20 are illustrated. In an aspect, the six door systems 20 provide three enclosed area access points, and the door systems 20 operate in pairs; one door system 20 of a pair allows entry into the secured location 12 and the other door system 20 of the pair provides an exit from the secured location area 12, wherein the area outside of the exit is monitored by a radar system 300. In another aspect, a single door system 20 may be used for both entry to and exit from the secured location 12, in which case radar system 300, while positioned in the secured location monitors the unsecured location 13 outside the single door system 20.

FIG. 1A shows each door system 20 pair in communication with a separate access controller 100. However, other combinations of controllers 100 and door systems 20 may be implemented in the system 10. For example, a single controller 100 may control all door systems 20 for the secured location 12.

The credential & policy directory 200 shown in FIG. 1A may represent one or many actual directories. The directories may be located remotely from the secured location 12. The directories may be operated by entities other than the operator of the secured location 12. For example, the secured location 12 may be a sensitive compartmented information facility (SCIF) for a government contractor, and the directory 200 may represent a directory for the government contractor and a directory for a government agency.

A directory 200 may include identification information (name, age, physical characteristics, photograph) for individuals who may be allowed access to the secured location 12, the identification credentials of the individuals (PIN/password, RFID tag, certificate), and other information.

FIG. 1C illustrates an example door system that may be implemented in the system of FIG. 1A. In FIG. 1C, door system 20 is shown in communication with access controller 100 over communication path 130. The door systems 20 includes access door 22, door locking mechanism 24, door controller 26, and credential reader 28. The door 22 may be any door that allows individuals to enter or exit the enclosed area. The door 22 may include a position sensor (e.g., a limit switch—not shown) that indicates when the door 22 is not fully closed. The position sensor may send a not-fully-closed signal over signal path 21 to the door controller 26. The not-fully-closed signal may be sent continuously or periodically, and may not be sent until after a predefined time has expired.

The locking mechanism includes a remotely operated electro-mechanical locking element (not shown) such as a dead bolt that is positioned (locked or unlocked) in response to an electrical signal sent over signal path 21 from the door controller 26.

The door controller 26 receives credential information over signal path 29 from credential reader 28 and passes the information to the access controller 100 over signal path 130. The door controller 26 receives lock/unlock signals from access controller over signal path 130. The door controller 26 sends lock mechanism lock/unlock signals over signal path 21 to locking mechanism 24.

The credential reader 28 receives credential information 40 for an individual 42. The credential information 40 may be encoded in an RFID chip, a credential on a smart card, a PIN/password input using a key pad, biometric data such as fingerprint and retina scan data, for example.

The door systems 20 operates based on access request signals sent to the access controller 100 and access authorization signals received, in response, from the access controller 100. The door systems 20 may incorporate an auto lock feature that activates (locks) the door 22 within a specified time after the door 22 is opened and then shut, after an unlock signal has been sent to the locking mechanism 24 but the door 22 not opened within a specified time, or under other conditions. The auto lock logic may be implemented in the door controller 26 or the locking mechanism 24.

The door systems 20 may send event signals to the event monitoring system 250 by way of the access controller 100. Such signals include door open, door closed, locking mechanism locked and locking mechanism unlocked. As noted above, the signals may originate from limit switches in the door systems 20.

In an aspect, a door system 20 may be used only for entry and a separate door system 20 may be used only for exit, in which case radar system 300 will monitor the unsecured location 13 outside of the door system 20 used for exit.

However configured, the door systems 20 may indicate when an individual 42 is in the secured location 12 and when the individual 42 has exited the secured location 12, based on information obtained by reading credential information 40 of the individual 42 on entry and exit, respectively. These signals may be used to prevent reentry without an intervening exit, for example. The signals (or their absence) also may be used to prevent access to areas and systems within the enclosed area. For example, the individual 42 may not be allowed to log onto his computer in the secured location 12 in the absence of an entry signal originating from one of the door systems 20 of the secured location 12. Thus, the access controller and its implemented security functions may be a first step in a cascading series of access operations the individual may be exposed to.

The door systems 20 may incorporate various alarms such as for a propped open door 22, a stuck unlocked locking mechanism 24, and other indications of breach or fault.

Radar System

Figure 2A:
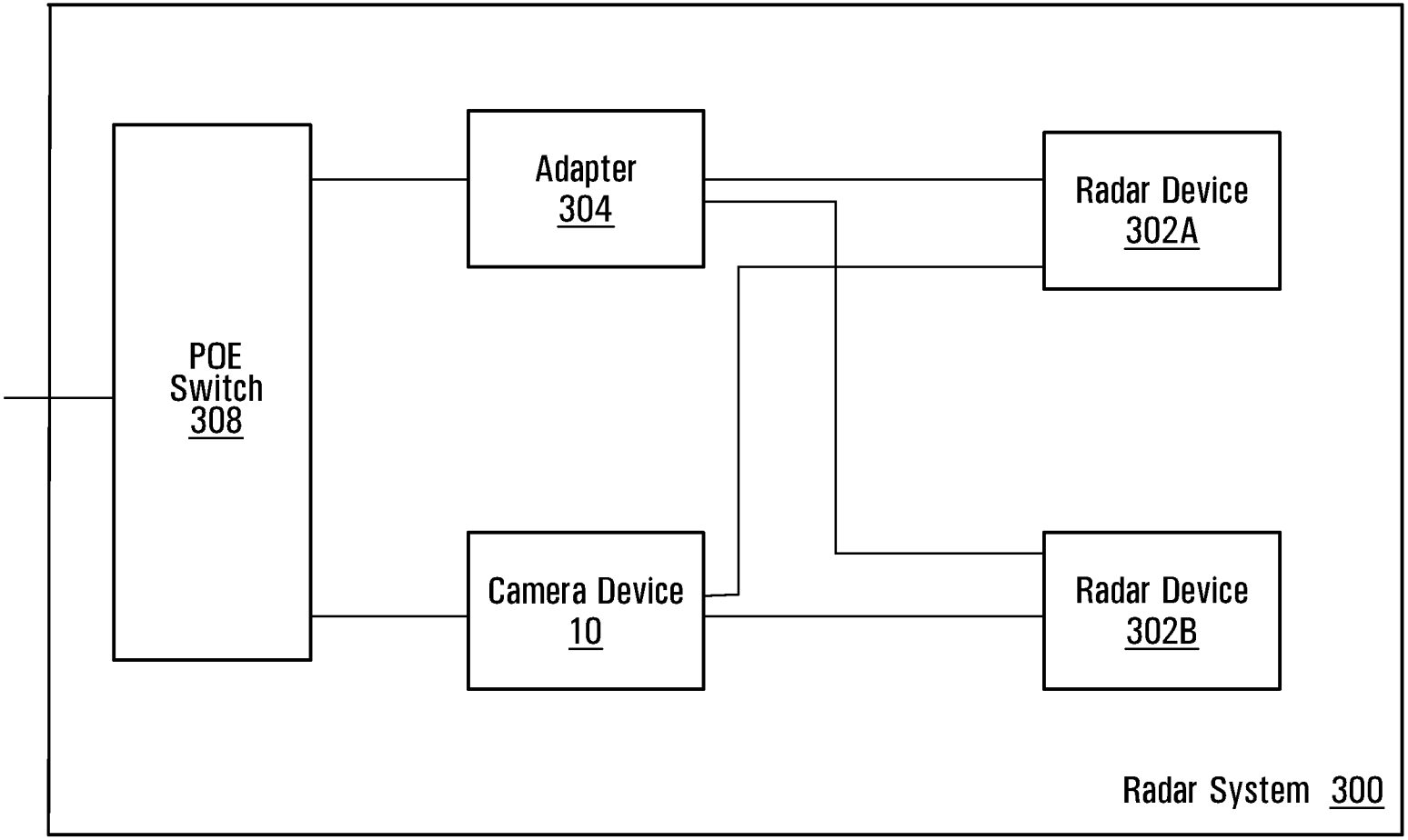
FIGS. 2A and 2B are a block diagram of example radar systems, according to embodiments.
Figure 2B:
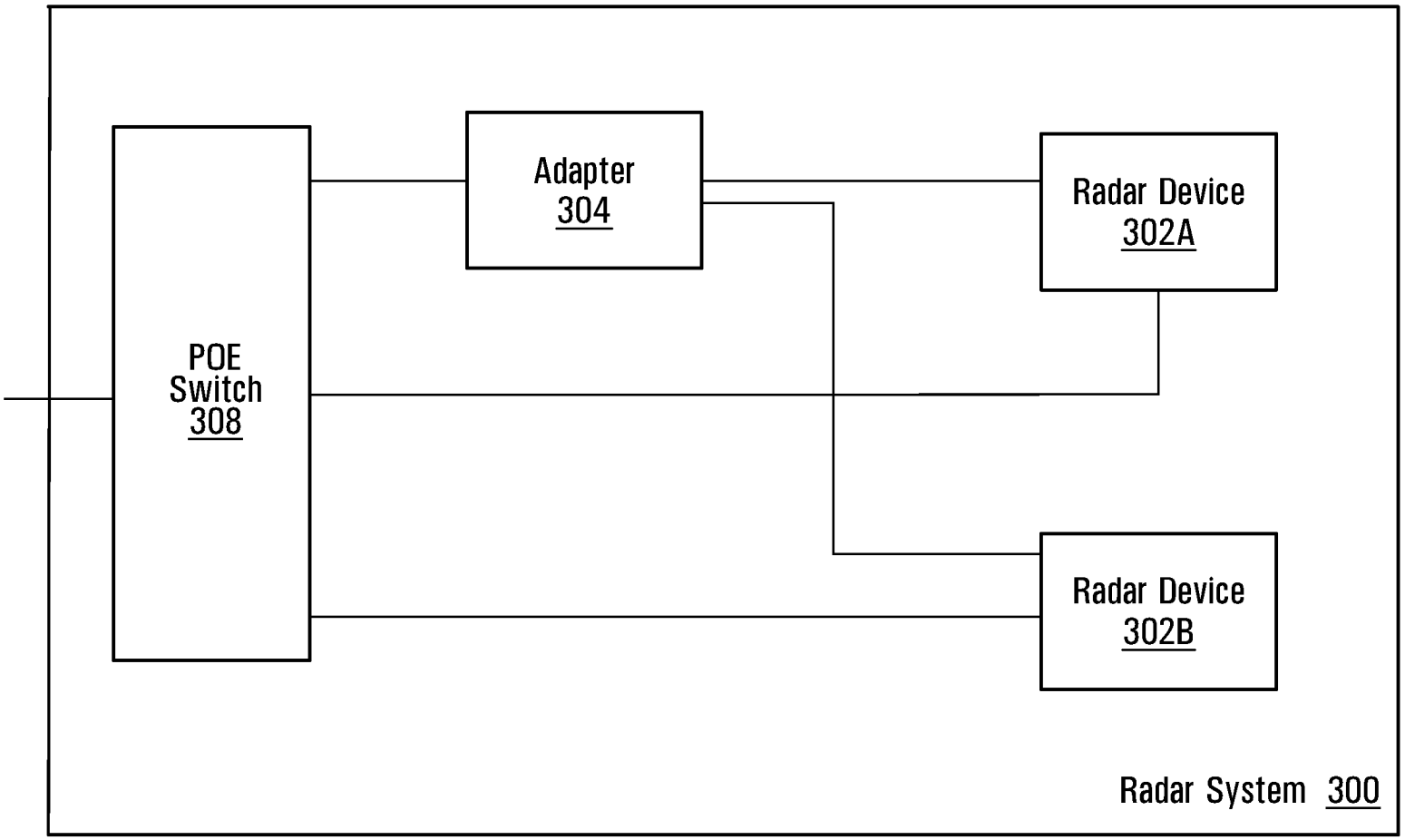

Referring now to FIGS. 2A and 2B, radar system 300 is depicted. Radar system 300 may be powered wirelessly, or via alternative means, including a direct power connection to a power source, such as using Power over Ethernet (POE). The radar system 300 may include two radar devices 302A and 302B, each communicatively coupled to camera device 10, for example using a cable connected to relay contacts; and power adaptor 304, for example using a power cable, including for example a 5 VDC and a ground cable. Power adaptor 304 converts signals received from POE switch 308, for example from an Ethernet cable, into power for radar devices 302A, 302B, and camera device 10. Data signals are sent from radar devices 302A, 302B to camera 10 for further processing at camera device 10 or sent by camera device 10 through POE switch 308, using for example an Ethernet cable, for further processing. In alternative embodiments, radar system 300 be communicatively coupled to access controller 100 directly in place of camera device 10. Alternatively, radar device 302A may be a standalone device providing alerts directly to network 50.

Referring now to FIG. 2B, radar system 300 is depicted, as previously disclosed, but without the presence of camera device 10. Radar system 300 may be powered wirelessly, or via alternative means, including a direct power connection to a power source, such as using Power over Ethernet (POE). The radar system 300 may include two radar devices 302A and 302B, each communicatively coupled to POE switch 308, for example using a cable connected to relay contacts; and power adaptor 304, for example using a power cable, including for example a 5 VDC and a ground cable. Power adaptor 304 converts signals received from POE switch 308, for example from an Ethernet cable, into power for radar devices 302A, 302B. Data signals are sent from radar devices 302A, 302B to POE switch 308, using for example an Ethernet cable, for further processing.

Figure 3:
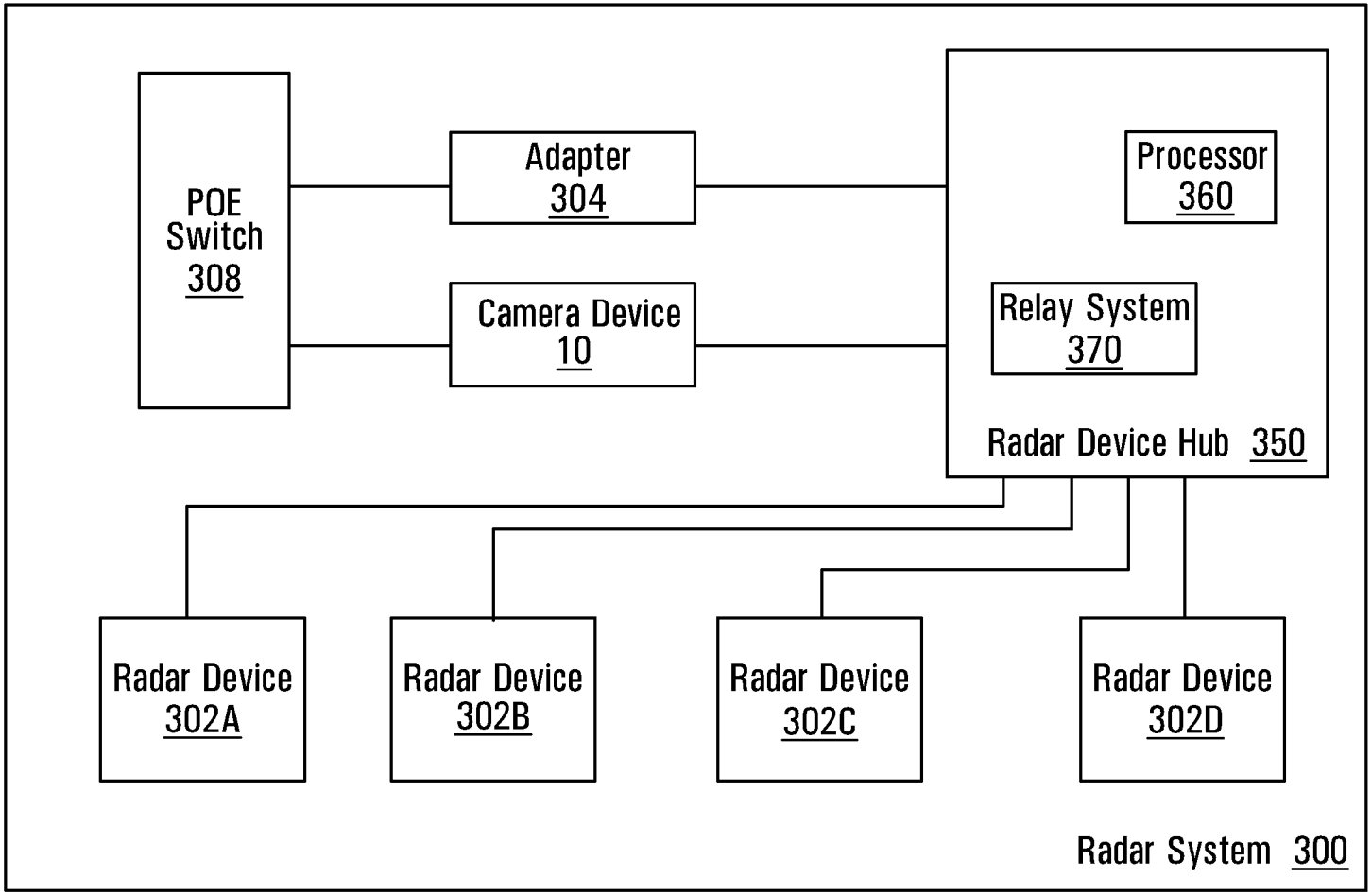
FIG. 3 is a block diagram of an alternative example radar system, according to an embodiment.

Referring now to FIG. 3, radar system 300, in an alternative embodiment, includes radar devices 302A, 302B, 302C, and 302D, each communicatively coupled, for example via a USB connection, to a radar device hub 350 to provide data to and receive instructions from camera device 10, and receive power through radar device hub 350. Radar device hub 350 is coupled to both POE adaptor 304, for example through a 5 VDC and ground line, to receive power through POE adaptor 304; and to camera device 10, to which radar device hub 350 sends data signals for further processing. POE adaptor 304 and camera device 10 are each communicatively coupled, for example via Ethernet cables, to POE switch 308. Radar system 300 may contain as few as s single radar device 302, or four or more radar devices 302.

Radar device hub 350 may be mounted above the ceiling of the secured location 12, and includes a processor 360 to configure and collect data received from radar devices 302A, 302B, 302C, and 302D. If a presence, such as a human presence, is detected by one of radar devices 302A, 302B, 302C, and 302D a relay system 370 in radar device hub 350 is energized and relays a message to camera device 10, access controller 100 and/or the network 50, as appropriate.

Figure 4:
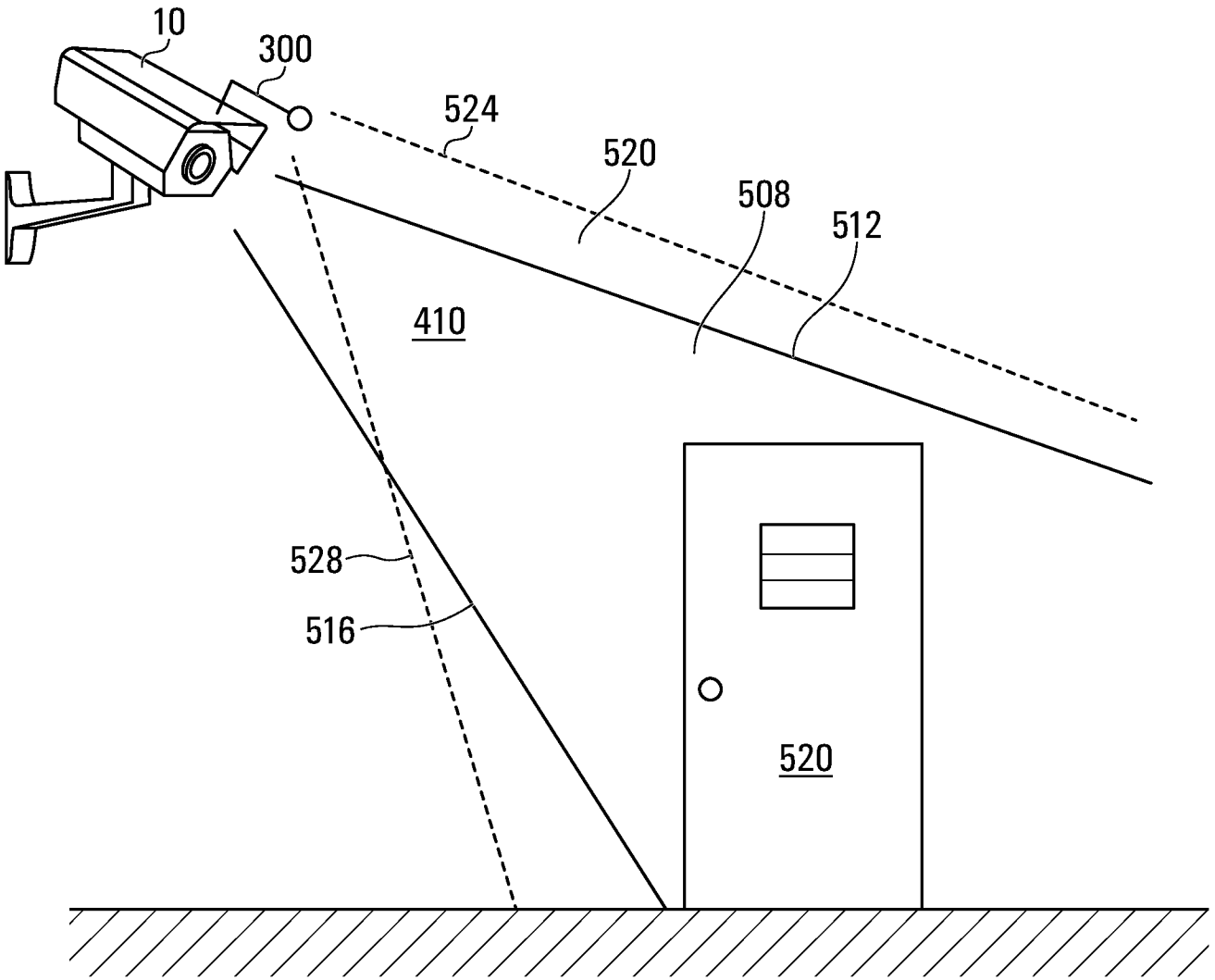
FIG. 4 is a schematic diagram of an example deployment of a radar system, according to an embodiment.

Referring now to FIG. 4, therein illustrated is a schematic diagram of an example deployment of a radar system 300 with camera 10 and an exit door system 20. The camera 10 has a field of view 508, which may be substantially conical. In the illustrated example, the field of view 508 is defined by its upper boundary 512 and lower boundary 516. The radar system 300 has a field of view 520 defined by its upper boundary 524, lower boundary 528 and which passes through wall 410 and door system 20. It will be appreciated that the field of view 508 is fully encompassed within field of view 520 (but for a space close to the optical unit of the camera device 10 and a space on the opposite side of wall 410). The camera device 10 and radar system 300 is oriented so as to capture door system 20 and the unsecured location 13 on the opposite side of door system 20 and wall 410.

Figure 5:
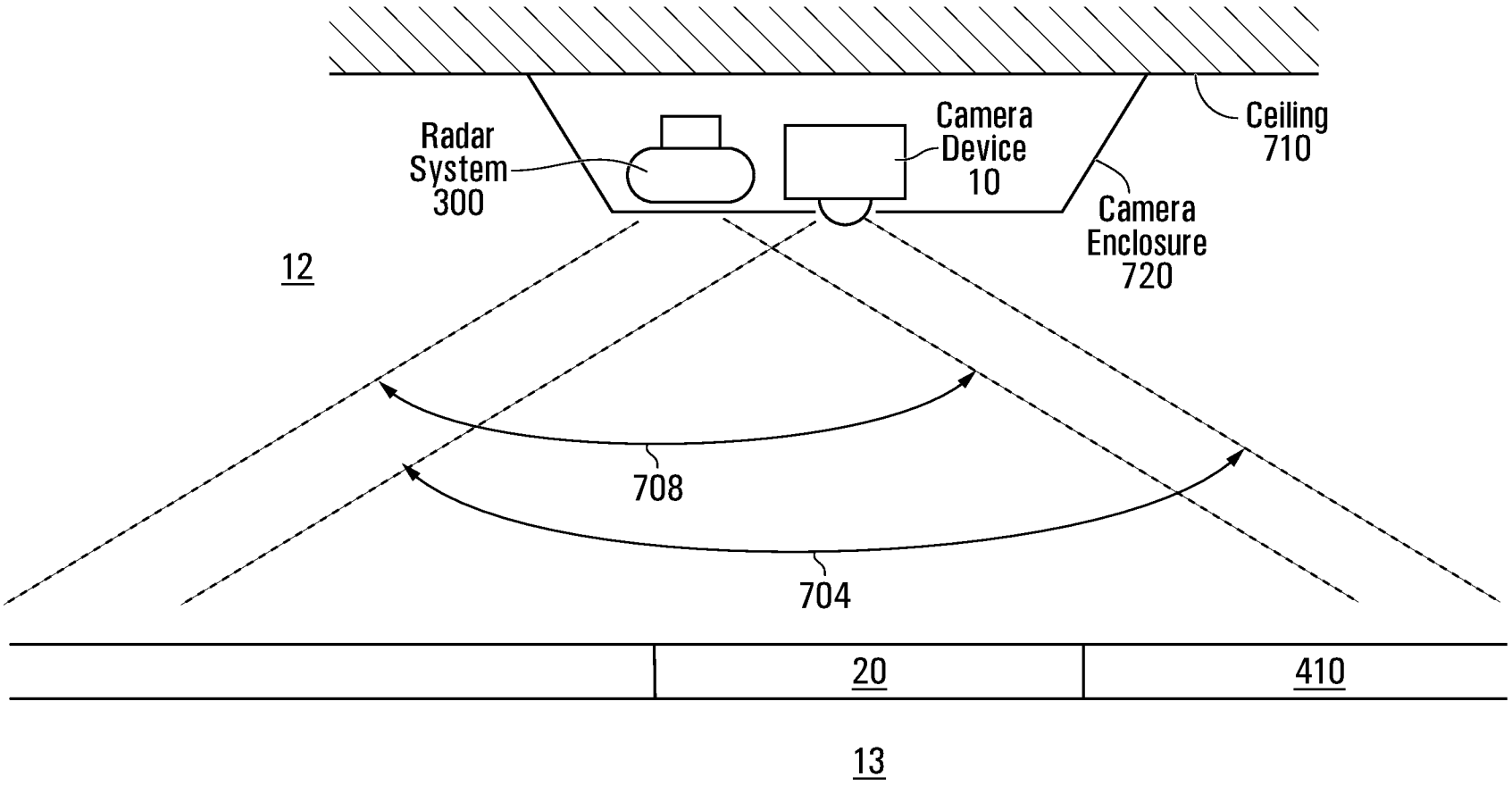
FIG. 5 is a schematic diagram of an example ceiling deployment of a camera device and radar system according to an embodiment.

Referring now to FIG. 5, therein illustrated is a schematic diagram of an example ceiling deployment of a camera device 10 and radar system 300. Camera device 10, which is shown as a fisheye camera, but may be a dome camera or PTZ camera, with field of view 704, may be mounted in enclosure 720. Enclosure 720 is secured to ceiling 710, within, for example, secured location 12. Radar system 300, with field of view 708, may be positioned in enclosure 720 adjacent to camera device 10, so that field of views 704 and 708 overlap. In this embodiment camera device 10 can provide additional data related to alerts relayed by radar system 300. Radar system 300, so positioned can monitor the unsecured location 13 outside of door system 20 and through wall 410.

Figure 6:
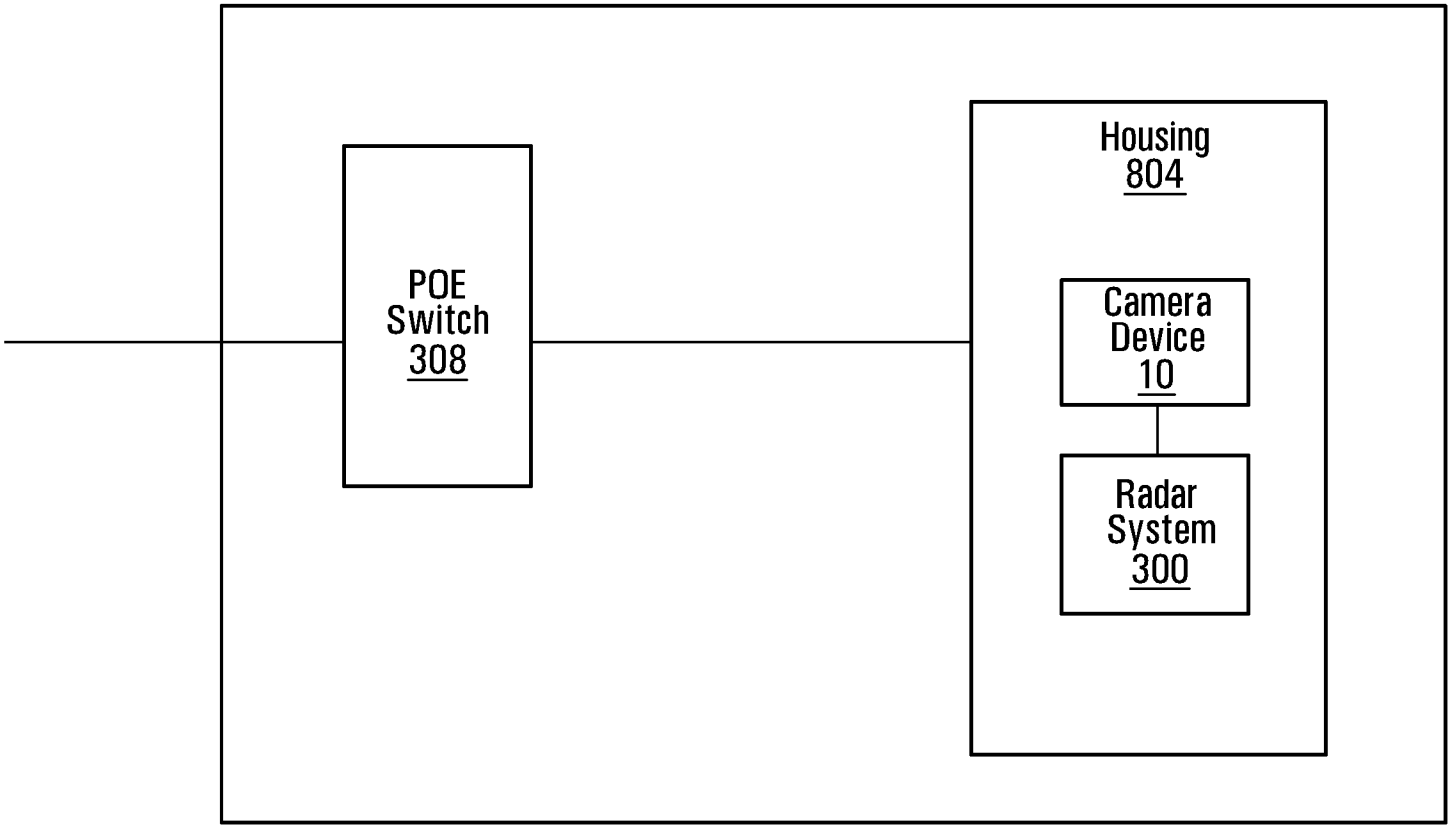
FIG. 6 is a block diagram of an example camera device and radar system within a housing according to an embodiment.

Referring now to FIG. 6, therein illustrated is a block diagram of an example embodiment of a camera device 10 and radar system 300 within a housing 804. Radar device 300 may be communicatively coupled, via a cable, such as a USB cable, to camera device 10 within housing 804. Camera device 10 may receive power from and transmit output data to POE switch 308 through a cable, such as an Ethernet cable.

Figure 7:
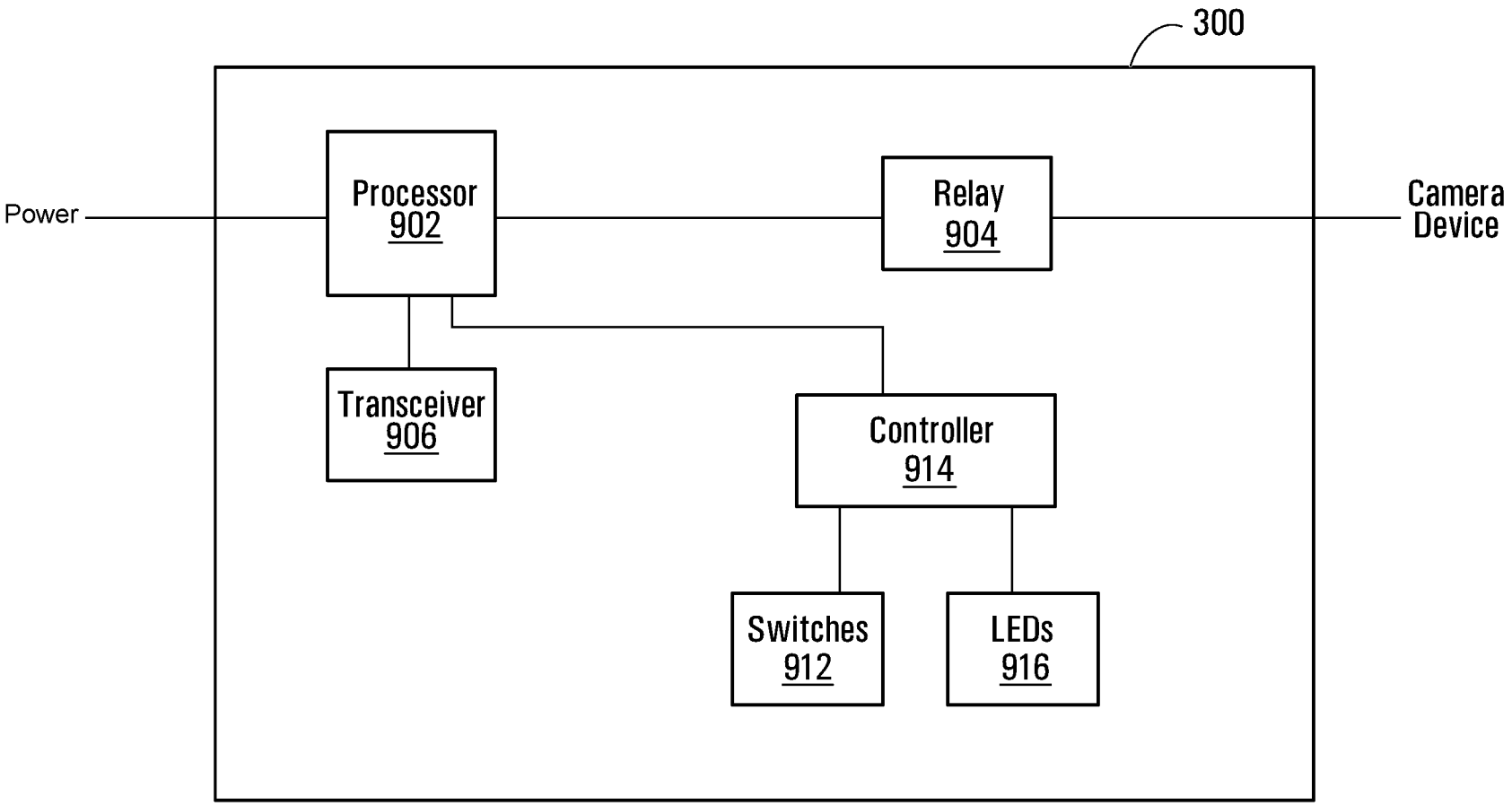
FIG. 7 is a block diagram of an example radar system, according to another embodiment.

Referring now to FIG. 7, therein illustrated is a block diagram of an alternative example embodiment of a radar system 300. Radar system 300 includes processor 902 which may be an ARM-based CPU or similar CPU, and which receives power, which may be received wirelessly, via POE, or other means. Processor 902 is communicatively coupled to, and receives input from radar transceiver 906, which may be an Ultra-Wideband (UWB) Radar Sensor' and outputs to camera device 10 through relay 904. Controller 914, communicatively coupled to processor 902 and which may be a Breakout board, controls indicators, such as light emitting diodes (LEDs) 916 and may be operated by switches 912.

Figure 8A:
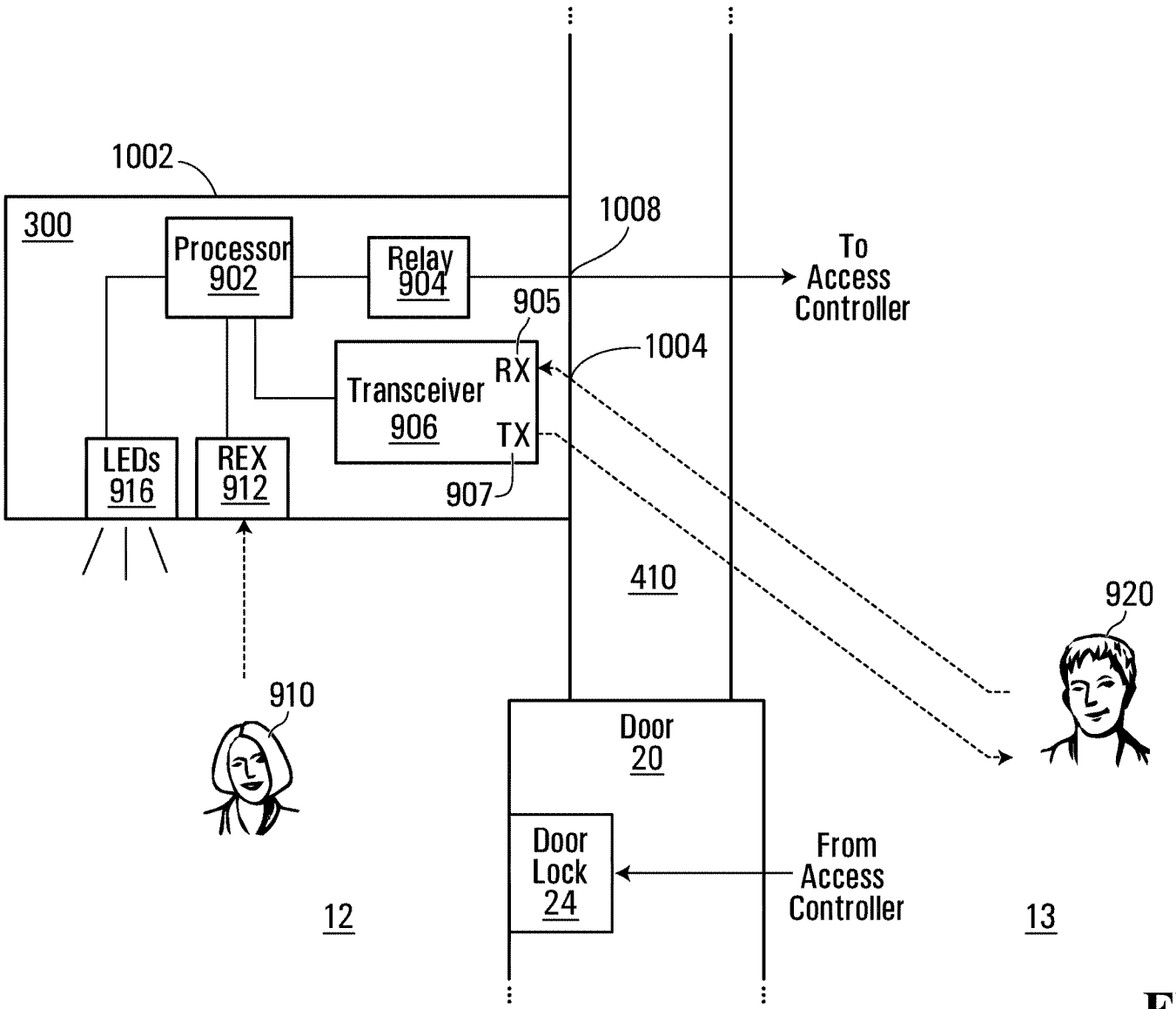
FIGS. 8A and 8B are diagrammatic illustrations of an example radar system in use, according to an embodiment.
Figure 8B:
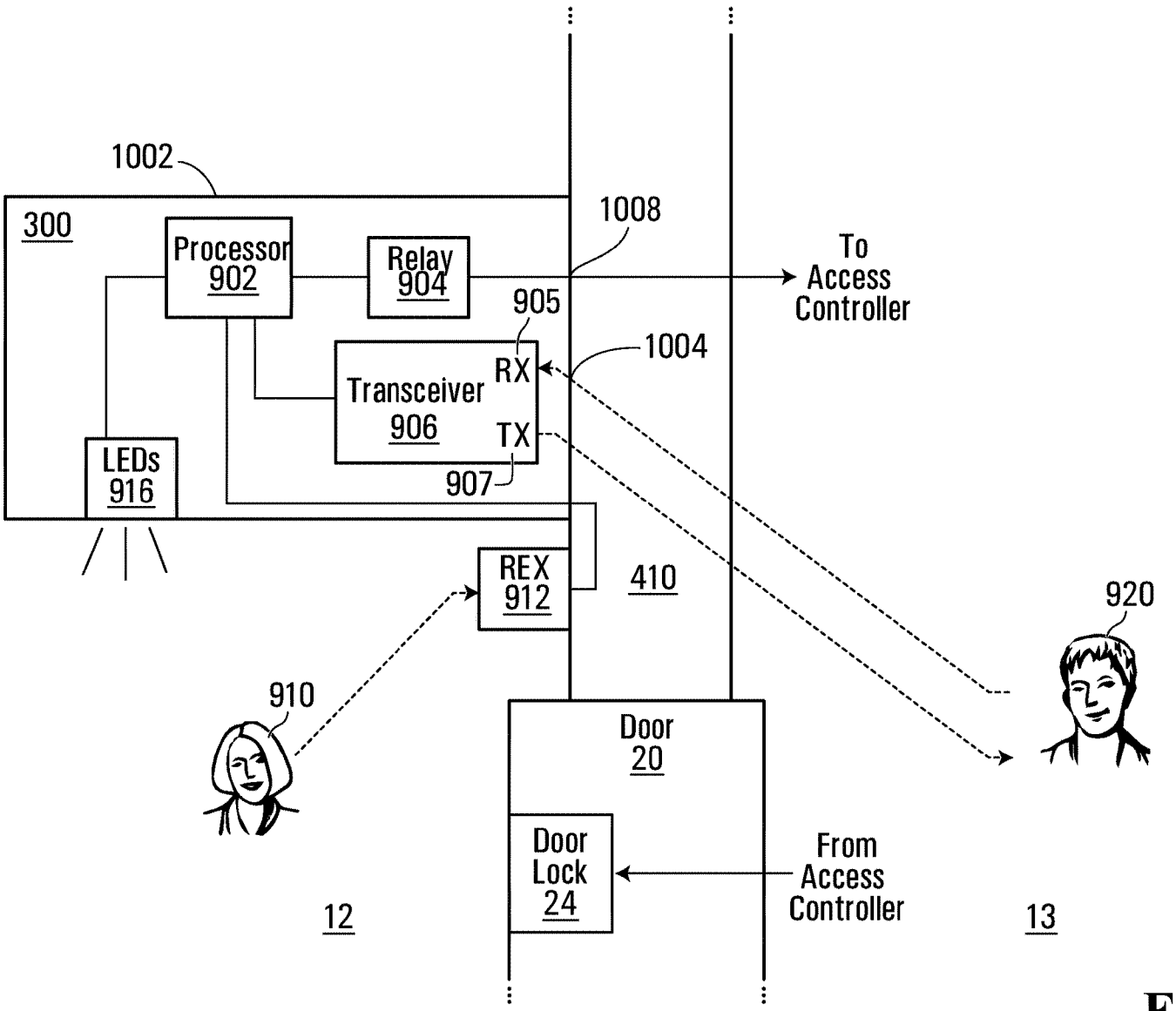

Referring now to FIGS. 8A and 8B, therein illustrated is are embodiments of an example of a radar system 300. Radar system 300 includes enclosure 1002, to protect the internal elements of radar system 300. Enclosure 1002 is made of material transparent to radar signals. Opposite enclosure is back plate 1004, typically a flat plate to meet with a surface for mounting radar system 300. Aperture 1008 allows a cable or other connector to enter enclosure 1002 to enable communication through relay 904 to access controller 100. LEDs 916 positioned on enclosure 1002 can be configured to provide status information regarding radar system 300, for example the presence of a person 920 in unsecured location 13.

Radar system 300 works by transceiver 906 sending, through transmitter antenna (TX) 907, and receiving, through receiver antenna (RX) 905, radar signals. A returning signal will indicate the distance to a detected object and the Doppler Effect is used to determine a portion of the velocity of the detected object as indicated by the change in frequency of the returned radar signal as determined using a Fourier transformation. Comparing signals over time allows processor 902 to determine the direction of the detected object's motion. The radar signals pass through barrier 410.

Radar system 300 may be used to detect persons or animals, for example by detecting biometric indicators such as breathing or heartbeats. Detection of a human being as a living object, and not as a motionless object, can be performed by short-range radars using microwave signals ranging in frequency, waveform, duration, and bandwidth. Radar system 300 can even detect people not actively moving, only breathing and with a heartbeat, and thereby determine the presence of a sleeping person.

On reflection from a person, or an animal, a radar signal acquires specific biometrical modulation, which does not occur in reflections from inanimate objects. This modulation is produced by heartbeats, pulsations of vessels, lungs, and skin vibrations in the region of the person's thorax and larynx, which occur synchronously with breathing motions and heartbeat. These processes are nearly periodic, with typical frequencies in the range of 0.8-2.5 Hz for heartbeat and 0.2-0.5 Hz for breathing. Therefore, the delay or phase of the reflected signal is periodically modulated by these periodic oscillations. The modulation parameters are thus determined by the frequencies and intensities of respiration and heartbeat.

The sensitivity of radar probing in the gigahertz band may reach $10^{-9}$ m. In practice, radar probing of live persons or animals is performed against the background of reflections from local objects. The intensity of these reflections typically exceeds the intensity of signals from a living object. The signals from a living object, however, are distinguishable by periodic and aperiodic modulation synchronous with respiration and heartbeat. Modulation of this type is either absent in signals reflected from inanimate objects or has different time and spectral characteristics. This allows for recognition of signals reflected by a living object against background reflections from inanimate objects.

Radar systems 300 may use probing signals of different types, for example unmodulated monochromatic signals, ultrawideband (UWB) video pulses, and wideband sinusoidal frequency-modulated (SFM) signals. The main advantage of wideband and ultrawideband signals over monochromatic signals is that they allow the range separation of targets from exterior interference, such as reflections from inanimate objects.

Figure 9:
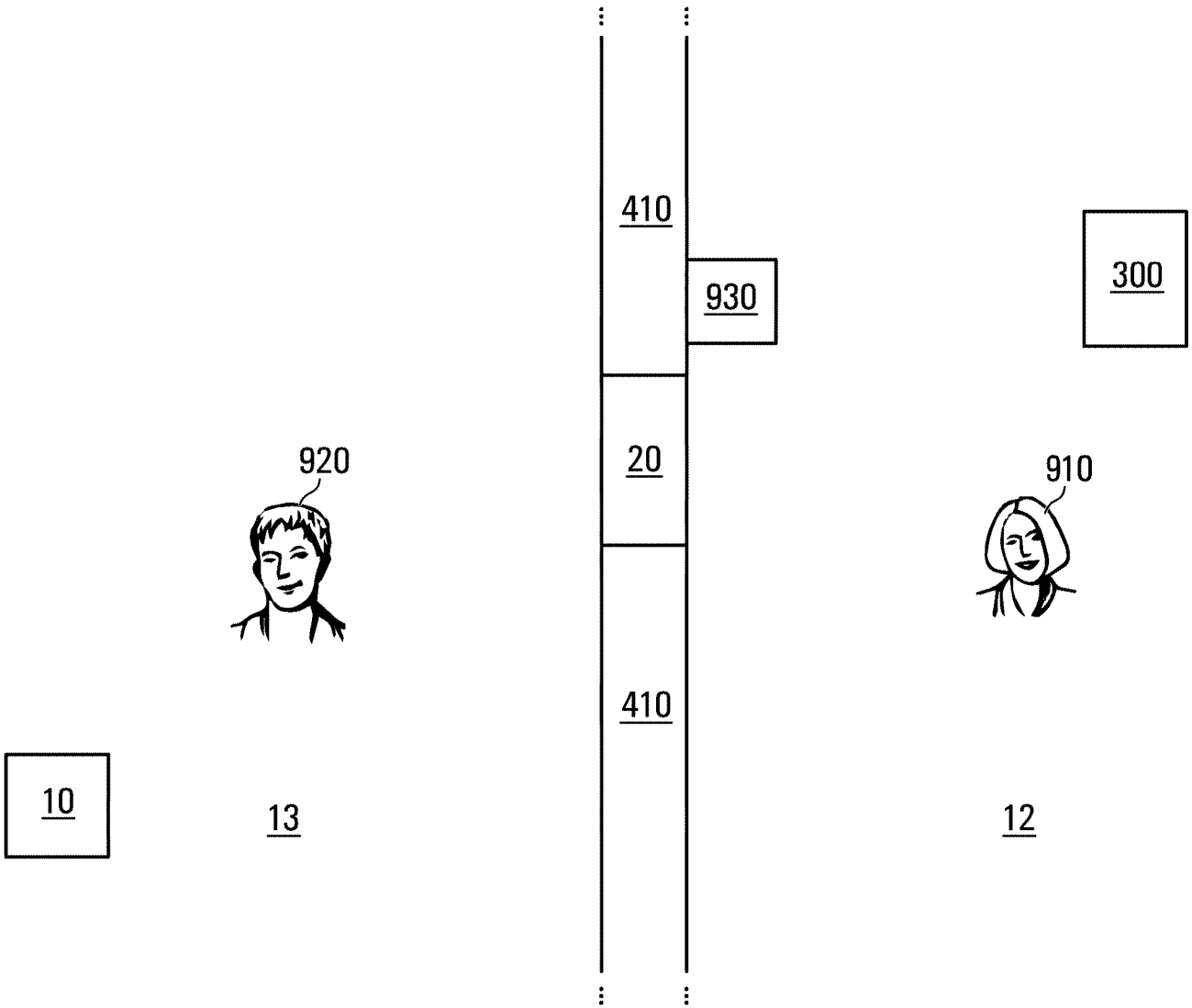
FIG. 9 is an illustration of an example of the positioning of a radar system, according to an embodiment.

As shown in FIG. 9, radar system 300 is configured to transmit and receive radar signals, to and from respectively, unsecured location 13. Radar system 300 is positioned in secured location 12 so that it cannot be damaged or otherwise interfered with from unsecured location 13. Alternatively, radar system 300 may be positioned in unsecured location 13 if the risk of tampering is low or the enclosure is made of hardened materials.

A passage, such as door system 20 is positioned to allow persons with credentials exiting secured location 12 to reach unsecured location 13 through barrier 410. door system 20 is secured, for example through the use of a locked hinged door, a sliding door, alarms, or other means of controlling movement from the unsecured location 13 to secured location 12. door system 20 may be controlled by access controller 100.

On receipt of a REX request from an authorized person 910, access controller 100 receives input from radar system 300. If no person is detected in unsecured location 13 near to door system 20, then door system 20 is opened and authorized person 910 may exit.

If an unauthorized person 920 is detected by radar system 300, access controller 100 is notified and may be configured to take a number of actions. For example, access controller 100 may maintain door system 20 in a locked or secure position, so that door system 20 will not allow passage of persons through a barrier, such as wall 410. Alternatively, access controller 100 may generate a report or provide instructions to actuate an alarm so that the unauthorized person 920 may be removed from proximity to the door system 20 by guards or the like. Once the unauthorized person 920 is no longer detected, or is at least a certain predetermined distance from door system 20, door system 20 may be unlocked and/or opened to allow access by authorized person 910 in the secured location 12.

In another embodiment, light 930 may be positioned on wall 410 and actuated when unauthorized person 920 is detected by radar system 300. Authorized person 910 can then determine the risk of opening door system 20 by viewing light 930.

A camera 10 may be placed in unsecured location 13 so that when an alert is generated, for example light 930 is activated, authorized person 910 can view a video stream from camera 10 from secured location 12.

In yet another alternative embodiment, access control system 11 may be able to determine if unauthorized person 920 in unsecured location 13, is in fact authorized, before sending an alarm, alert or notification by using an appropriate security measure. For example, an RFID system may be in place to detect a RFID tag on unauthorized person 920, which may indicate if the person is fact, authorized, in which case an alert would not be raised.

With reference to FIG. 8A, in an embodiment, authorized person 910 may trigger radar system 300 by approaching REX 912, which is communicatively coupled to processor 902 and may be integrated with radar system 300, and which may for example be a card reader that authorizes the exit of authorized person 910. Radar system 300 detects the presence of unauthorized person 920 in the unsecured location 13 near door system 20 and activates LEDs 916 to display an alert to authorized person 910 and/or maintains lock mechanism 24 in place to prevent door system 20 from opening. In an alternative embodiment, as shown in FIG. 8B, REX 912 is positioned close to door system 20. In this embodiment, REX 912 is a separate device rather than integrated with radar system 300.

Figure 10:
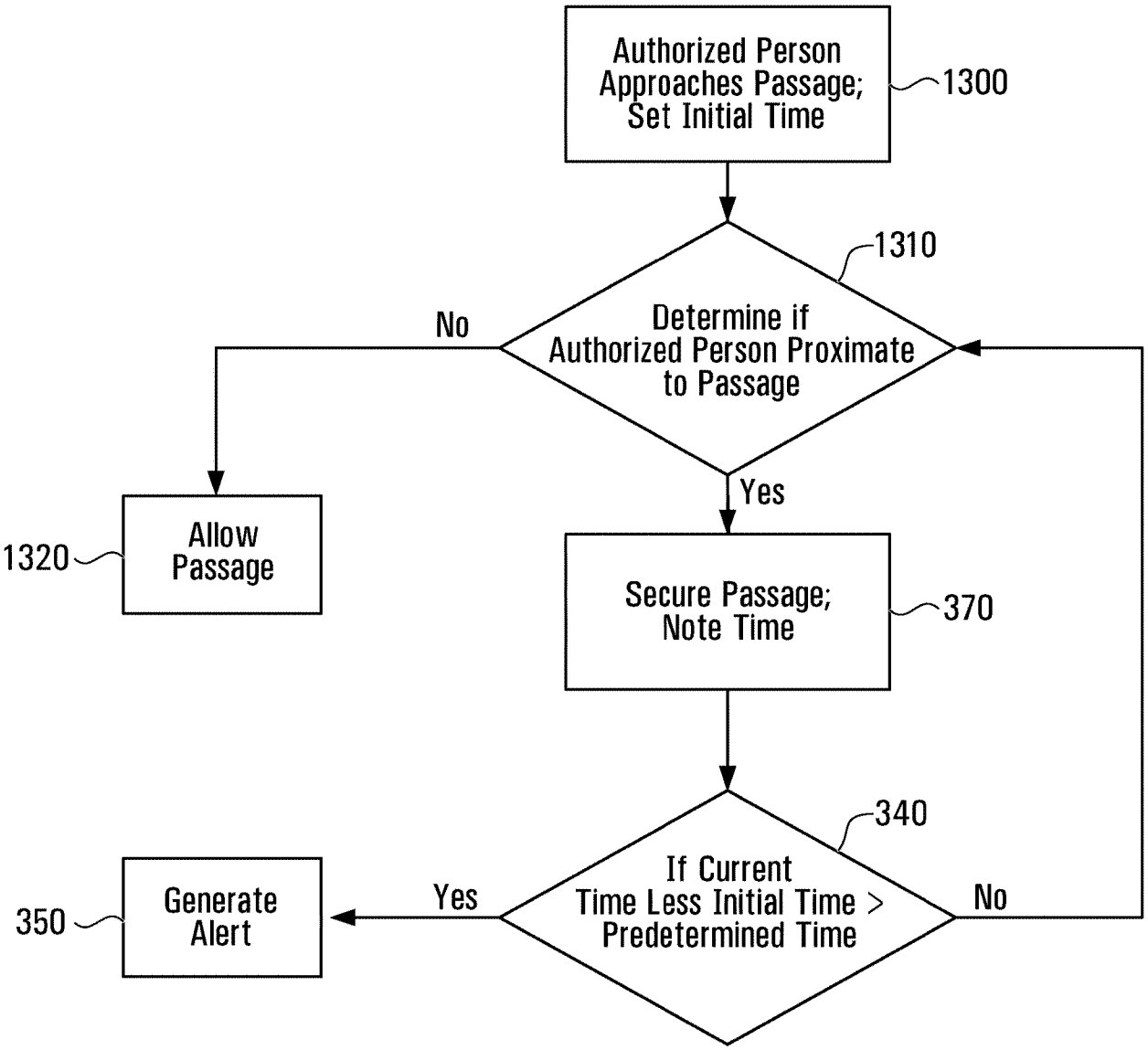
FIG. 10 is a flow chart of an example use case of the radar system, according to an embodiment.

An example of a use case of radar system 300 which occurs when an authorized person 910 desires to exit the secured location 12 via a passage, such as a door system 20, is shown in FIG. 10. Authorized person 910 first approaches the passage or requests to exit via the passage, in which case the initial time is set (step 1300). Radar system 300 is used to determine if an unauthorized person 920 is proximate to the passage (step 1310). Proximate may be relative to the location of the passage, for example if the passage exits onto a busy city street, proximate may be no more than a few feet, while in a more remote area, proximate may be measured as within a person's ability to reach the passage prior to the passage closing, for example before a door closes. If no unauthorized person 920 is detected, the passage is unlocked or opened, and the authorized person 910 is permitted to exit (step 1320) to unsecured location 13.

Alternatively, if an unauthorized person 920 is detected, the passage remains secured (for example, closed or locked) and the time is noted (step 1330). The current time is then compared to the initial time (step 1340). If a predetermined time has not passed, radar system 300 again determines if the unauthorized person 920 is still proximate to the passage (step 1310). If the predetermined time has passed, then an alert is generated (step 1350), which could, for example result in guards removing the unauthorized person. The alert may be sent to the authorized person 910 to notify them of the risk of using the passage.

Radar system 300 should be configured to distinguish persons from immobile objects and animals (and other non-human moving entities, such as vehicles), so that actions to alert or prevent use of the passage occur only when a risk is presented.

The use of radar system 300 thus provides a non-visual based alert system which has the benefit of not being affected by lighting conditions, and which can also be completely hidden from view in a ceiling or in a secured location 12 to prevent tampering.

The processor 902 used in the foregoing embodiments may be, for example, a microprocessor, microcontroller, programmable logic controller, field programmable gate array, or an application-specific integrated circuit. Examples of computer readable media which may carry instructions operable by processor 902 are non-transitory and include disc-based media such as CD-ROMs and DVDs, magnetic media such as hard drives and other forms of magnetic disk storage, semiconductor based media such as flash media, random access memory, and read only memory.

Another variant might be to pair the radar device 300 with a people counter. In this way if the door 22 is forced open during an alarm (possibly by a manual override button likely necessary for a fire code), then system 10 can detect if someone actually did enter when door 22 was open for the authorized person 910 to leave.

In further alternative embodiments, the determination of the presence of the authorized person 910 in the secured location 12 may triggered by a second person in the unsecured location 13 moving proximate to a passage or requesting to enter through the passage. The passage may be secured. The passage may be open if the authorized person 910 is not detected or presents credentials. The passage, which may be a door 22, allows movement thought the barrier 410, which may be a wall. The alert may be provided to the second person. This embodiment could be used, for example, in a behavior health ward in which patients are present who should not be able to exit through the passage when a visitor arrives. The passage may be a two door air-lock or man-trap hallway, so it is possible for a patient to sneak into this hallway and wait for a visitor to open the entrance door. Typically these patients are in plain clothes so a visitor may unknowingly let a patient out as they enter. This embodiment may also be used when the secured location 12 is a prison containing inmates who may be hiding waiting for the passage to open so they can escape.

It is contemplated that any part of any aspect or embodiment discussed in this specification can be implemented or combined with any part of any other aspect or embodiment discussed in this specification.

For the sake of convenience, the example embodiments above are described as various interconnected functional blocks. This is not necessary, however, and there may be cases where these functional blocks are equivalently aggregated into a single logic device, program or operation with unclear boundaries. In any event, the functional blocks can be implemented by themselves, or in combination with other pieces of hardware or software.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A method for controlling a passage from a secured location to an unsecured location, comprising:

providing a radar system in the secured location, the radar system configured to:

transmit radar signals to the unsecured location through a barrier separating the secured and unsecured locations; and receive, through the barrier, reflected radar signals from the unsecured location proximate to the passage; and on determination of the presence, by the radar system, of a first person in the unsecured location proximate to the passage, providing an alert while the barrier prevents movement of the first person from the unsecured location to the secured location;

wherein the determination of the presence of the first person is triggered by a second person in the secured location requesting to exit through the passage.

2. The method of claim 1 wherein the passage is secured.

3. The method of claim 2 further comprising opening the passage when the radar system does not determine the presence of the first person.

4. The method of claim 1 further comprising opening the passage if the first person presents credentials.

5. The method of claim 1 wherein the alert is provided to the second person.

6. The method of claim 1 wherein the passage allows movement through the barrier.

7. The method of claim 6 wherein the barrier is at least one of: a wall, a hedge, and a geofence.

8. The method of claim 1 wherein the passage is at least one of: a door and a gate.

9. A physical security system, comprising:

a radar system located in a secured location outside a passage from the secured location to an unsecured location, the radar system configured to:

transmit, through a barrier separating the unsecured and secured locations, radar signals to the unsecured location;

receive, through the barrier, reflected radar signals from the unsecured location;

a processor in communication with the radar system and configured to:

determine, using the reflected radar signals, if the reflected radar signals indicate a presence of a first person in the unsecured location; and on determination using the reflected radar signals of the presence of the first person, provide instructions to cause an alert or prevent use of the passage while the barrier prevents movement of the first person from the unsecured location to the secured location;

wherein the determination of the presence of the first person in the unsecured location occurs when a second person in the secure location requests to exit through the passage.

10. The system of claim 9 wherein the passage is locked, and wherein the processor is configured to provide instructions to open the passage.

11. The system of claim 9 wherein the processor is further configured to provide instructions to open the passage when the reflected radar signals do not indicate the presence of the first person.

12. The system of claim 9 wherein the processor is further configured to provide instructions to allow movement through the passage if the second person presents credentials.

13. The system of claim 9 wherein the processor is configured to provide instructions to provide the alert to the second person.

* * * * *